US007245855B2

(12) United States Patent
Yasumoto

(10) Patent No.: US 7,245,855 B2
(45) Date of Patent: Jul. 17, 2007

(54) OPENING AND CLOSING DEVICE, SHEET CONVEYING APPARATUS, AND IMAGE FORMING APPARATUS

(75) Inventor: Takeshi Yasumoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 179 days.

(21) Appl. No.: 11/088,759

(22) Filed: Mar. 25, 2005

(65) Prior Publication Data

US 2005/0214028 A1 Sep. 29, 2005

(30) Foreign Application Priority Data

Mar. 29, 2004 (JP) ..... 2004-096920

(51) Int. Cl.
*G03G 21/00* (2006.01)

(52) U.S. Cl. ..... 399/124

(58) Field of Classification Search ..... 399/124
See application file for complete search history.

(56) References Cited

U.S. PATENT DOCUMENTS

| | | | | |
|---|---|---|---|---|
| 4,171,901 | A * | 10/1979 | Takizawa et al. | 399/210 |
| 4,673,279 | A * | 6/1987 | Brown | 399/402 |
| 4,711,550 | A * | 12/1987 | Sumida et al. | 399/401 |
| 4,766,461 | A * | 8/1988 | Ohtsuka | 399/144 |
| 2001/0036379 | A1* | 11/2001 | Takahashi et al. | 399/401 |
| 2005/0214027 | A1 | 9/2005 | Yasumoto | 399/124 |
| 2005/0214028 | A1 | 9/2005 | Yasumoto | 399/124 |

FOREIGN PATENT DOCUMENTS

| | | |
|---|---|---|
| JP | 11-84791 | 3/1999 |
| JP | 11-84982 | 3/1999 |
| JP | 2003-15237 | 1/2003 |

OTHER PUBLICATIONS

Computer translation of JP11-084982a.*

* cited by examiner

*Primary Examiner*—Quana Grainger
(74) *Attorney, Agent, or Firm*—Fitzpatrick, Cella, Harper & Scinto

(57) ABSTRACT

An opening and closing device including: a fixed side member; a movable side member retained by the fixed side member to be opened and closed freely; a wire member that is fixed at one end thereof to one of the fixed side member and the movable side member; a rotary member that is provided in the other of the fixed side member and the movable side member, has the wire member wound therearound when the movable side member is closed, and rotates in such a direction as to draw out the wire member when the movable side member is opened; and an elastic member that is provided in the rotary member and accumulates an elastic force which causes the rotary member to rotate reversely to a direction in which the rotary member rotates when the wire member is drawn out, due to rotation of the rotary member at a time when the wire member is drawn out.

12 Claims, 13 Drawing Sheets

OPENING AND CLOSING DEVICE, SHEET CONVEYING APPARATUS, AND IMAGE FORMING APPARATUS

BACKGROUND OF THE INVENTION

1. Field of the Invention

The present invention relates to an opening and closing device, a sheet conveying apparatus, and an image forming apparatus, and more particularly to a constitution for opening and closing an opening and closing portion constituted by a fixed side member and a movable side member.

2. Related Background Art

Conventionally, for example, in an image forming apparatus such as a printer, a fax machine, a copier, or a printing press, images are formed by an image forming method such as an electrophotographic process, an offset printing method, or an ink-jet method. As an example of such an image forming apparatus, there is a color image forming apparatus that forms color images by the electrophotographic process. Such a color image forming apparatus adopts a tandem method in which a plurality of image forming units constituting an image forming portion are arranged side by side, a rotary method in which a plurality of image forming units are cylindrically arranged, or the like. A transfer method for such a color image forming apparatus is classified into a direct transfer method in which a toner image is directly transferred from a photosensitive member onto a sheet and an intermediate transfer method in which a toner image is transferred first onto an intermediate transfer member and then onto a sheet.

Herein, in an intermediate transfer tandem method in which a plurality of (four) image forming units are arranged side by side on an intermediate transfer belt, there is no need to retain a sheet on a transfer drum or a transfer belt unlike the case of the direct transfer method. Therefore, the intermediate transfer tandem method is advantageous in that a great variety of sheets including ultra-thick papers and coated papers can be dealt with and that a sheet path to a secondary transfer portion for transferring an image onto a sheet from the intermediate transfer belt can be simply structured. Moreover, since the degree of freedom in stretching the intermediate transfer belt is high, the intermediate transfer tandem method is advantageous in reducing the size of the image forming apparatus as well.

In addition to the above-mentioned merits, the tandem method offers a highly advantageous constitution in accomplishing speedup because of its features including a parallel processing in a plurality of image forming units and a batch transfer of full-color images. Therefore, the tandem method is suited for a color image forming apparatus, which is targeted for high productivity.

In such a color image forming apparatus, it is necessary to have access to a relevant portion from the outside of the apparatus during replenishment, replacement, and service maintenance of consumables, or during an operation of removing a sheet etc., at the time of jamming. For this reason, the color image forming apparatus is provided with various opening and closing portions. Further, in the case where the color image forming apparatus is provided with an original reader, this original reader is provided with an original pressure cover as an opening and closing portion. In using the original reader, a user operates the original pressure cover in its opening and closing directions.

For such an opening and closing portion, there have been proposed various opening and closing devices that are intended to prevent a damage from being caused by a dropping impact of a movable side member such as a door, to reduce the load imposed on an operator, and so forth. Herein, some of the simplest ones of such opening and closing devices are provided with a wire member (a wire, a rope, a chain, a ribbon, or the like) which also serves to regulate an opening and closing angle so as to prevent the opening and closing portion from opening beyond a certain angle. In the opening and closing device as described above, however, the wire member may be fractured due to an impact unless the movable side member to be opened and closed is light or the opening and closing angle is relatively small.

On this account, if the movable side member to be opened and closed is heavy, an opening and closing device equipped with a shock absorber such as a damper is often employed. Herein, such an opening and closing device is broadly classified into three types depending on where the shock absorber is installed.

In the first type, a shock absorber supports a turning end of a movable side member such as a door, which is open, for example, after having been turned downwards. This type has a merit in that since the neighborhood of the turning end which is most distant from a turning center of the movable side member is supported, the force required for support can be held relatively small even when the movable side member is heavy (e.g., as disclosed in Japanese Patent Application Laid-Open No. H11-84791).

In the second type, a shock absorber is provided at a turning center of a movable side member. This type has a merit in that since there is no need to provide the turning end with a support portion, an ample open space with a clean-cut constitution can be achieved (e.g., as disclosed in Japanese Patent Application Laid-Open No. 2003-15237).

In the third type, a member interlocking with a movable side member is provided with a shock absorber. This type has a merit in that since the location for installing the shock absorber is not particularly limited to an opening or a turning center, a high degree of freedom in layout is obtained (e.g., as disclosed in Japanese Patent Application Laid-Open No. H11-84982).

However, in an opening and closing device and an image forming apparatus provided with the conventional shock absorber as described above, for example, in the case of the opening and closing device disclosed in Japanese Patent Application Laid-Open No. H11-84791, there is a problem in that the opening and closing device cannot be easily applied to an opening and closing portion with a limited vertical dimension in particular because of a large installation space for a damper.

Further, in the case of the opening and closing device disclosed in Japanese Patent Application Laid-Open No. 2003-15237, the installation space for the damper can be reduced by providing the damper at the turning center (i.e., on the turning shaft). However, since the largest load is imposed on the turning center in supporting the movable side member, the required torque capacity increases and the size of the damper also increases as the weight of the movable side member increases. Thus, the hinged structure is enlarged in size, which causes a problem in that it is difficult to reduce the thickness of the opening and closing device.

Further, the opening and closing device disclosed in Japanese Patent Application Laid-Open No. H11-84982 adopts a method in which the load applied to the rotary damper is dispersed by providing an interlocking member interlocking with the movable side member with the rotary damper and an extension spring as auxiliary damper means.

However, if the opening and closing portion is a sheet conveying passage, for example, a rigid body such as the interlocking member must be structured not to shut off the sheet conveying passage when a guide plate or the like constituting the sheet conveying passage is closed.

In the case of such a structure, however, the space required for other members than the sheet conveying passage increases and consequently, the sheet conveying apparatus is considerably enlarged in size. Furthermore, in a place requiring a large opening and closing angle, since the length of the interlocking member or the operating length of the extension spring increases, the space required for opening and closing operations increases in either case.

On the other hand, as a rule, in the case where high productivity, high reliability, and high durability are especially demanded of an image forming apparatus, its respective units demonstrate high rigidity and tend to increase in size and weight. In the case of such an image forming apparatus, it is also necessary to give careful consideration to what does not raise a serious problem in the field of office equipments and the like, for example, an opening and closing operational force that is applied in coping with the jamming of the sheet conveying passage.

Further, in the case where the sheet conveying passage is disposed in a lower portion of the image forming apparatus, since a user assumes a stooping posture in coping with the jamming of the apparatus, it is highly necessary to lighten the load imposed on the user. In addition, as the productivity of the image forming apparatus is enhanced, the image forming portion and the like increase in size and become complicated, and enhancement of the capacity of a sheet feeding device is also desired. From the standpoint of usability, however, the position of an operating portion or the height of the image forming apparatus body cannot be changed with ease. Therefore, it takes on great significance how to reduce the thickness and size of the opening and closing device for opening and closing the opening and closing portion such as the sheet conveying passage.

SUMMARY OF THE INVENTION

According to one aspect of the invention, an opening and closing device includes:

a fixed side member;

a movable side member retained by the fixed side member to be opened and closed freely;

a wire member that is fixed at one end thereof to one of the fixed side member and the movable side member;

a rotary member that is provided in the other of the fixed side member and the movable side member, has the wire member wound therearound when the movable side member is closed, and rotates in such a direction as to draw out the wire member when the movable side member is opened;

an elastic member that is provided in the rotary member and accumulates an elastic force which causes the rotary member to rotate reversely to a direction in which the rotary member rotates when the wire member is drawn out, due to rotation of the rotary member at a time when the wire member is drawn out;

a damper which reduces a speed of the rotation of the rotary member; and rotation transmitting means for selectively transmitting rotation of the rotary member to the damper, wherein the rotation transmitting means transmits rotation of the rotary member to the damper when the movable side member is opened, and does not transmit rotation of the rotary member to the damper when the movable side member is closed.

According to another aspect of the invention, a sheet conveying apparatus includes:

a fixed side member;

a movable side member retained by the fixed side member to be opened and closed;

guide plates provided in the fixed side member and the movable side member, respectively, to guide a sheet, a wire member that is fixed at one end thereof to one of the fixed side member and the movable side member;

a rotary member that is provided in the other of the fixed side member and the movable side member, has the wire member wound therearound when the movable side member is closed, and rotates in such a direction as to draw out the wire member when the movable side member is opened;

an elastic member that is provided in the rotary member and accumulates an elastic force which causes the rotary member to rotate reversely to a direction in which the rotary member rotates when the wire member is drawn out, due to rotation of the rotary member at a time when the wire member is drawn out;

a damper which reduces a speed of the rotation of the rotary member; and rotation transmitting means for selectively transmitting rotation of the rotary member to the damper, wherein the rotation transmitting means transmits rotation of the rotary member to the damper when the movable side member is opened, and does not transmit rotation of the rotary member to the damper when the movable side member is closed.

According to another aspect of the invention, an image forming apparatus includes:

a sheet conveying apparatus including:

a fixed side member;

a movable side member retained by the fixed side member to be opened and closed; and guide plates provided in the fixed side member and the movable side member, respectively, to guide a sheet, an image forming portion that forms an image on the sheet guided by the guide plates;

a wire member that is fixed at one end thereof to one of the fixed side member and the movable side member;

a rotary member that is provided in the other of the fixed side member and the movable side member, has the wire member wound therearound when the movable side member is closed, and rotates in such a direction as to draw out the wire member when the movable side member is opened;

an elastic member that is provided in the rotary member and accumulates an elastic force which causes the rotary member to rotate reversely to a direction in which the rotary member rotates when the wire member is drawn out, due to rotation of the rotary member at a time when the wire member is drawn out;

a damper which reduces a speed of the rotation of the rotary member; and rotation transmitting means for selectively transmitting rotation of the rotary member to the damper, wherein the rotation transmitting means transmits rotation of the rotary member to the damper when the movable side member is opened, and does not transmit rotation of the rotary member to the damper when the movable side member is closed.

DESCRIPTION OF THE PREFERRED EMBODIMENTS

Best modes for implementing the present invention will be described hereinafter in detail with reference to the drawings.

Figure 1:
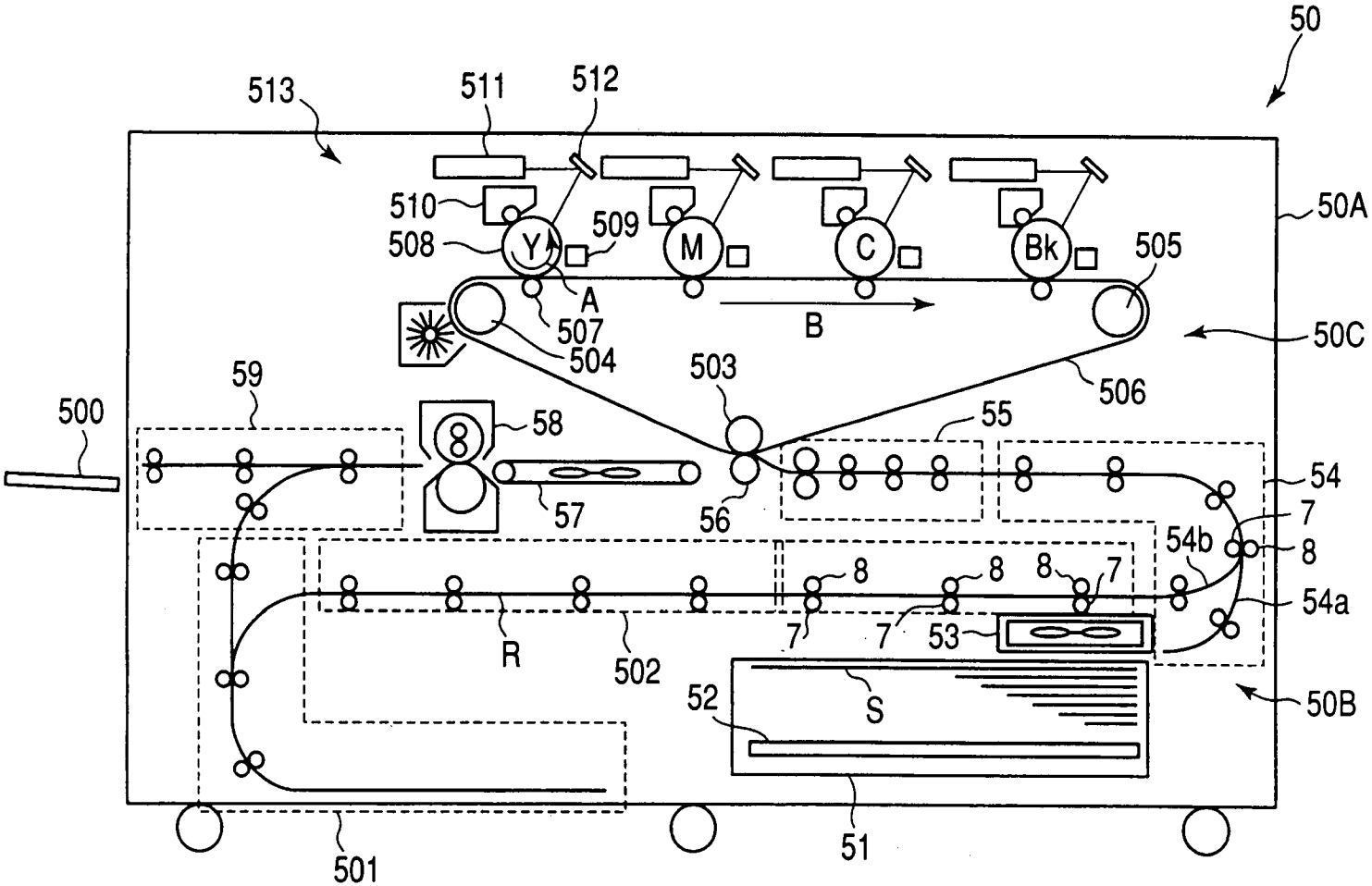
FIG. 1 is a view showing the overall constitution of a color image forming apparatus as an example of an image forming apparatus provided with an opening and closing device according to a first embodiment of the present invention.

FIG. 1 is a view showing the overall constitution of a color image forming apparatus as an example of an image forming apparatus provided with an opening and closing device according to a first embodiment of the present invention.

Referring to FIG. 1, reference symbols 50 and 50A denote a color image forming apparatus and a color image forming apparatus body (hereinafter referred to as the apparatus body), respectively. This apparatus body 50A is provided with an image forming portion 513, a sheet feeding portion 50B for feeding a sheet S, and a transfer portion 50C for transferring a toner image formed by the image forming portion 513 onto the sheet S fed from the sheet feeding portion 50B.

Herein, the image forming portion 513 is composed of image forming units of yellow (Y), magenta (M), cyan (C), and black (Bk). Each of these image forming units is constituted by a photosensitive member 508, an exposure device 511, a developing device 510, a primary transfer device 507, a photosensitive member cleaner 509, and the like. In other words, the color image forming apparatus according to this embodiment employs an intermediate transfer tandem method in which image forming units of four colors as an image forming portion are arranged side by side on an intermediate transfer belt that will be described later. The colors formed by the respective image forming units should not be limited to the aforementioned four colors. The sequence in which these colors are arranged should not be specified as described above either.

Further, the sheet feeding portion 50B is provided with a sheet accommodating portion 51 for accommodating sheets S stacked on a lift-up device 52 and sheet feeding means 53 for letting off the sheets S accommodated in the sheet accommodating portion 51. As this sheet feeding means 53, it is possible to mention a method of utilizing friction and separation by a sheet feeding roller or the like, a method of utilizing separation and adsorption by air, and so forth. In this embodiment, a method of feeding sheets by air is cited as an example.

The transfer portion 50C is provided with an intermediate transfer belt 506, which is stretched around a roller group including a driving roller 504, a tension roller 505, and a secondary transfer inner roller 503, and is driven to be conveyed in a direction indicated by an arrow B shown in FIG. 1.

Herein, due to a predetermined pressing force and a predetermined electrostatic load bias applied from the primary transfer device 507, a toner image formed on a photosensitive member is transferred onto this intermediate transfer belt 506. By applying a predetermined pressing force and a predetermined electrostatic load bias to a secondary transfer portion formed by the secondary transfer inner roller 503 and a secondary transfer outer roller 56 that are substantially opposed to each other, the intermediate transfer belt 506 causes an unfixed image to be adsorbed onto a sheet S.

In forming an image in the color image forming apparatus 50 thus constituted, on the basis of an image information signal transmitted, the exposure device 511 emits light to the photosensitive member 508. A surface of the photosensitive member 508, which rotates in a direction indicated by an arrow A shown in FIG. 1, is equally electrified in advance by electrifying means (not shown). The light is radiated suitably via reflection means 512 or the like, whereby a latent image is formed. A small amount of transfer toner remaining on the photosensitive member 508 is collected by the photosensitive member cleaner 509 and is stocked again to form another image.

Next, the developing device 510 performs toner development for the electrostatic latent image thus formed on the photosensitive member 508, so that a toner image is formed on the photosensitive member. After that, the primary transfer device 507 applies a predetermined pressing force and a predetermined electrostatic load bias to the intermediate transfer belt 506, onto which the toner image is then transferred.

An image is formed by the respective image forming units Y, M, C, and Bk of the image forming portion 513 at a timing of superposition on an upstream toner image primarily transferred onto the intermediate transfer belt. As a result, a full-color toner image is formed on the intermediate transfer belt 506 in the end.

Further, the sheet S is let off by the sheet feeding means 53 in accordance with an image forming timing of the image forming portion 513 and then is conveyed to a registration unit 55 through a conveying path 54*a* provided in the sheet conveying portion 54. Then, after having been subjected to a skew-feed correction and a timing correction in this registration unit 55, the sheet S is conveyed to the secondary transfer portion formed by the secondary transfer inner roller 503 and the secondary transfer outer roller 56. In the secondary transfer portion, the full-color toner image is secondarily transferred onto the sheet S.

Subsequently, the sheet S onto which the toner image has thus been secondarily transferred is conveyed to a fixing device 58 by a pre-fixing conveying portion 57. Then, in this fixing device 58, the toner is fused and fixed onto the sheet S by using a predetermined pressing force applied by substantially opposed rollers, belts, or the like, and a heating effect obtained from a heat source generally represented by a heater or the like.

Then, the sheet S having the fixed image thus obtained is directly ejected onto a sheet ejecting tray 500 by a branch-off conveying device 59. In the case where images are formed on both sides of the sheet S, the sheet S is thereafter conveyed to a surface reverse conveying device 501 by switching a changeover flapper (not shown).

Herein, after the sheet S has thus been conveyed to the surface reverse conveying portion 501, its front and rear ends are interchanged by performing a switchback operation, and then the sheet S is conveyed to a duplex conveying portion 502. After that, the sheet S passes through a duplex conveying passage R provided in the duplex conveying portion 502, joins another sheet conveyed from the sheet feeding portion 50B for a succeeding job from a sheet re-feeding path 54*b* of the sheet conveying portion 54 at the same timing, and then is sent to the secondary transfer portion in a similar manner. Because the same image forming process as on the first side of the sheet S is performed, the description thereof is omitted.

Figure 2:
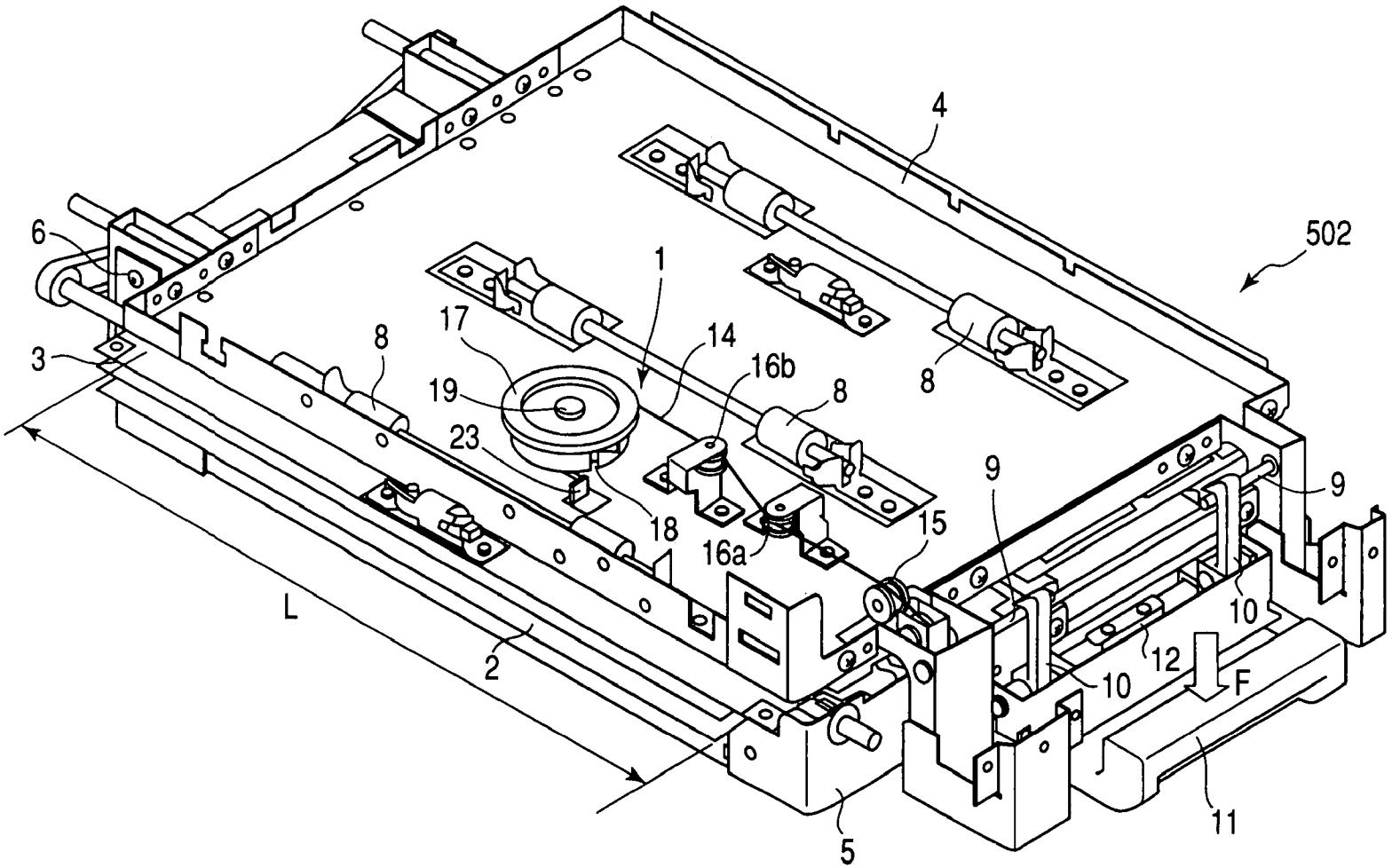
FIG. 2 is a perspective view showing a split part of a duplex conveying portion provided in the color image forming apparatus.
Figure 3:
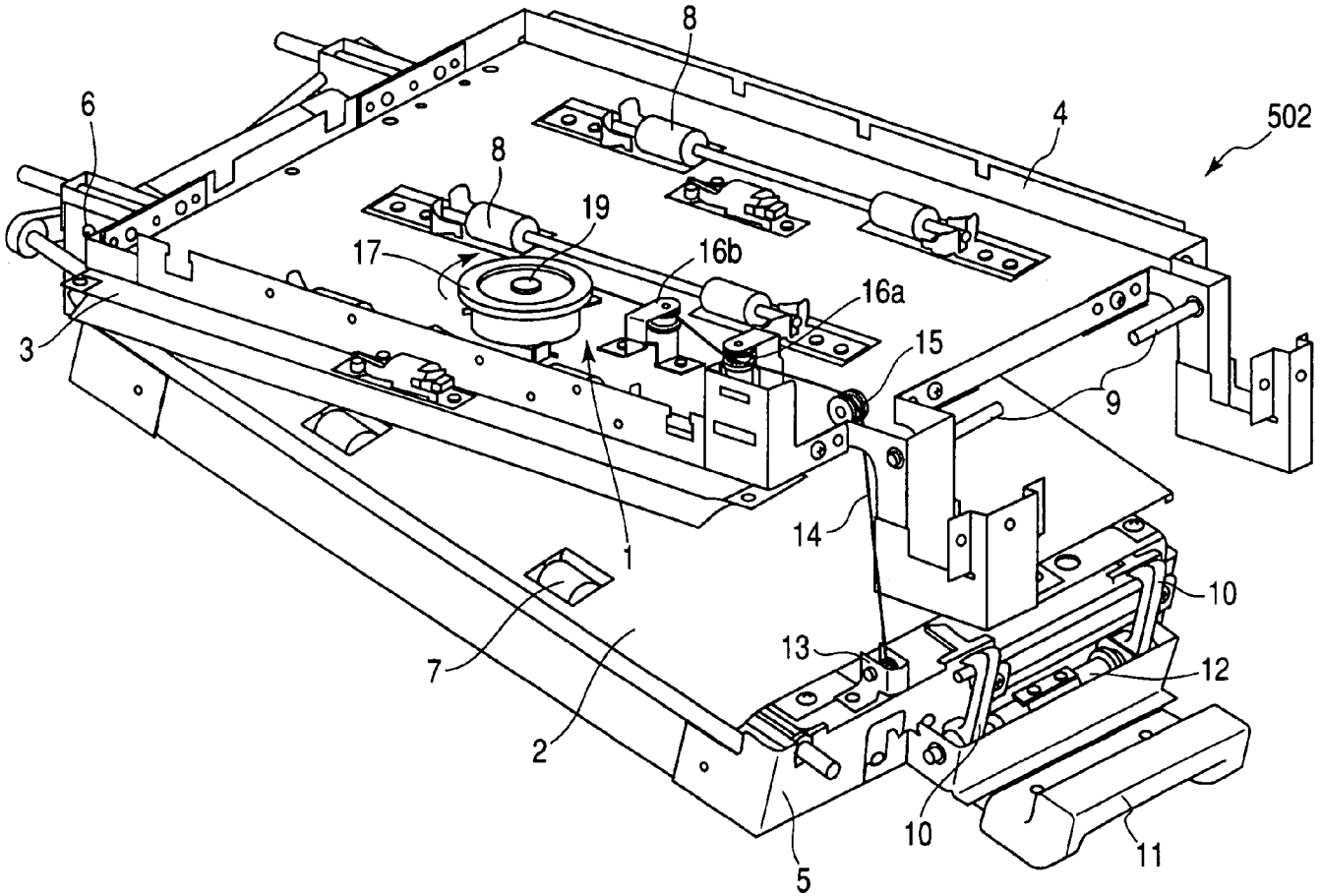
FIG. 3 is a view showing a state where a lower guide plate (lower frame) of the duplex conveying portion has been turned downwards.

In this embodiment, the duplex conveying portion 502 as an opening and closing portion is divided into a plurality of units perpendicularly to a direction in which the sheet S is conveyed. The respective units of the duplex conveying portion 502 are provided to be drawable from the apparatus body 50A. FIG. 2 shows one of the units into which the duplex conveying portion 502 as described above is divided. Referring to FIG. 2, an upper guide plate 3 and a lower guide plate 2 form the duplex conveying passage R. In the case where jamming occurs in the duplex conveying portion 502, the duplex conveying passage R is opened by fully drawing out this unit or this unit and another unit from the apparatus body and then turning the lower guide plate 2 downwards around a turning shaft 6 at the back as shown in FIG. 3. If there is a sufficient open space in the apparatus body, the lower guide plate 2 may be turned downwards while the duplex conveying portion 502 is secured in the image forming apparatus, without drawing out any of the units.

By thus opening the duplex conveying passage R, the sheets remaining in the duplex conveying portion 502 can be visually recognized. Therefore, a jamming sheet can be removed with ease.

Herein, the upper and lower guide plates 3 and 2 are supported by upper and lower frames 4 and 5 of the apparatus body respectively. Moreover, the upper and lower frames 4 and 5 are coupled and supported by the turning shaft 6. Further, the lower and upper guide plates 2 and 3 are rotatably provided with driving and driven rollers 7 and 8 respectively. These driving and driven rollers 7 and 8 sandwich and convey a sheet passing through the duplex conveying passage R.

By hooking a hook 10 provided in the lower frame 5 on a hook shaft 9 provided in the upper frame 4, the lower frame 5 is positioned by its own weight. Thus, the gap between the upper and lower guide plates 3 and 2 is determined.

Further, this hook 10 interlocks with an operating handle 11 provided in the lower frame 5 and turns around a shaft 12. In opening the duplex conveying passage R, the hook 10 is disengaged from the hook shaft 9 by pressing an upper face of the operating handle 11 in a direction indicated by an arrow F shown in FIG. 2. Consequently, the lower frame 5 is turned downwards as shown in FIG. 3.

In this embodiment, in order to realize the duplex conveying portion 502 as a high-rigidity, high-durability, and low-profile structure, most of the upper and lower guide plates 3 and 2, the upper and lower frames 4 and 5, and the like are made of metals. Further, since the upper and lower guide plates 3 and 2 have a great width L of about 400 mm to handle a large variety of sheets S, the lower frame 5 including the lower guide plate 2, the operating handle 11, and the like weighs 5 to 10 kg.

On this account, a large instantaneous load resulting from the weight of the lower frame 5 is applied to a user when the hook 10 is disengaged. This causes not only a heavy burden on the user performing an operation but also a strong impact in the case of free fall. Thus, a member for regulating the opening angle of the lower frame 5 or the turning shaft 6 may be damaged by the impact. For this reason, in this embodiment, the duplex conveying portion 502 is provided with an opening and closing device 1 for softening a dropping impact after disengagement of the hook 10.

Herein, this opening and closing device 1 has a suspensory portion 13 provided at a turning front end of the lower frame 5 as a movable side member retained to be turnable at a backside end of the upper frame 4 as a fixed side member, a wire 14 as a wire member fixed at one end thereof to the suspensory portion 13, a relay pulley 15 provided in the upper frame 4 in proximity to the turning front end of the lower frame 5, pulleys 16*a* and 16*b* disposed according to an installation space to guide the wire 14 guided and bent by the relay pulley 15, a rotary member 17 for holding the other end of the wire 14 guided by the pulleys 16*a* and 16*b*, and a torsion coil spring 20 as an elastic member for urging the rotary member 17 in a direction in which the wire 14 is wound around the rotary member 17. In this manner, the wire 14 is bent via the relay pulley 15 and then wound around an outer peripheral face of the cylindrical rotary member 17 via the pulleys 16*a* and 16*b*.

Figure 4:
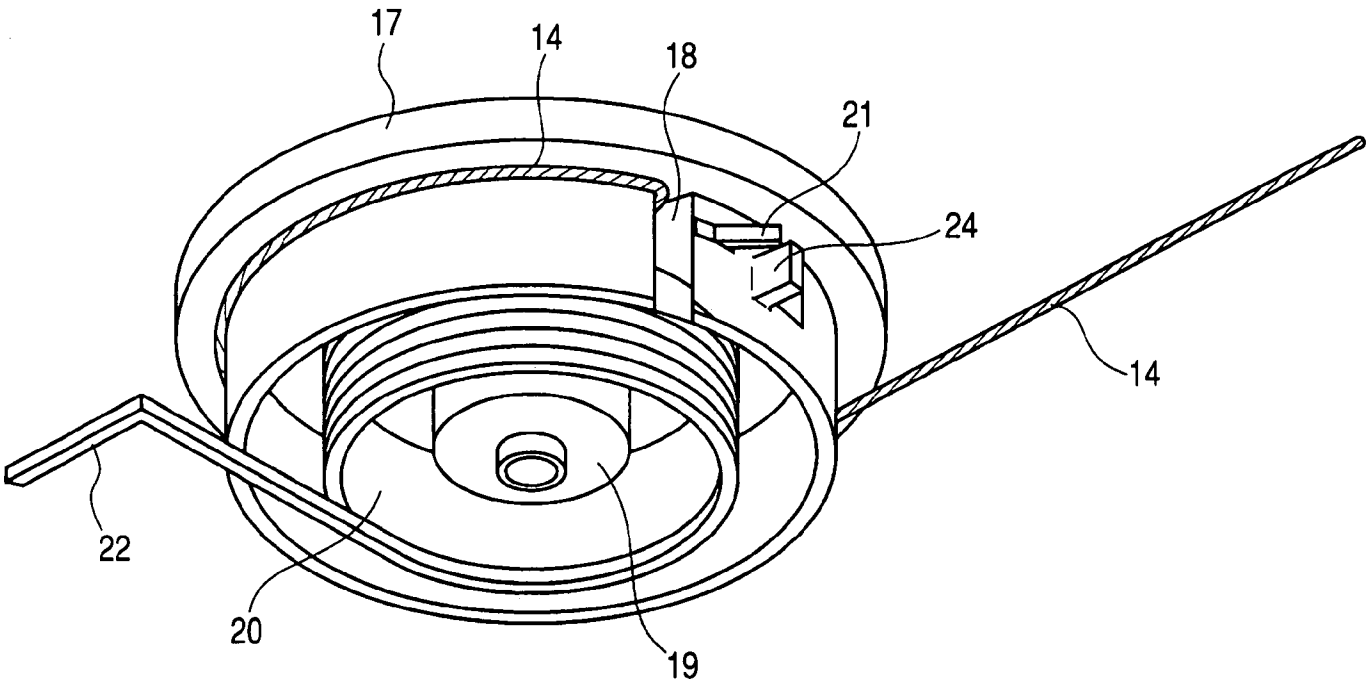
FIG. 4 is a view of a rotary member constituting the opening and closing device of the duplex conveying portion as viewed from an observing point diagonally downward thereof.

FIG. 4 is a view of the rotary member 17 constituting the opening and closing device 1 as viewed from an observing point diagonally downward thereof. After having been wound around the outer peripheral face of the cylindrical rotary member 17, the wire 14 goes into the rotary member 17 through a notched groove 18 formed in the outer peripheral face of the rotary member 17 and is fixed to a rotary center shaft 19 that rotatably holds the rotary member 17.

Herein, this rotary center shaft 19 is fixed to the upper frame 4 by means of caulking or the like, and the rotary member 17 is rotatably supported on an upper face of the upper frame 4 by a press-fitted bearing (not shown).

Moreover, a movable side arm 21 as one end of the torsion coil spring 20 provided inside the rotary member 17 is fixed by being hooked in the groove 18 formed in the outer peripheral face of the rotary member 17. A fixed side arm 22 as the other end of the torsion coil spring 20 protrudes outside from a lower side of the rotary member 17 and is fixed by being hooked on a bent riser 23 as a fixed member formed on the upper frame 4 shown in FIG. 2. For example, in a state shown in FIG. 2, the torsion coil spring 20 is twisted counterclockwise by a predetermined angle from a free state, when viewed from a direction of FIG. 4. An appropriate tensile force is thereby applied to the wire 14.

With the constitution described above, when the operating handle 11 is operated to release the hook 10 and the lower frame 5 thus turns downwards because of its own weight as shown in FIG. 3, the wire 14 attached to the suspensory portion 13 is pulled downwards. The wire 14 is drawn out while causing the rotary member 17 to rotate clockwise as indicated by an arrow shown in FIG. 3, namely, while twisting the torsion coil spring 20.

As shown in FIG. 4, the outer peripheral face of the rotary member 17 is provided with a salient portion 24 as rotation amount regulating means for regulating a rotation amount of the rotary member 17 so as to regulate a turning amount (opening amount) of the lower frame 5. By pressing the salient portion 24 against a regulating portion (not shown) provided in the upper frame 4 before the rotary member 17 rotates by 360° by being pulled by the wire 14, the amount of the wire 14 to be pulled (drawn out) is regulated. Thus, the downward turning amount of the lower frame 5 is regulated. Herein, by pressing the salient portion 24 against the regulating portion (not shown) in this manner, the rotary member 17 stops rotating before rotating through one revolution (360°). In other words, in this embodiment, the distance of the wire 14 to be drawn out is set shorter than a circumferential length of the rotary member 17.

In thus making a transition from the state shown in FIG. 2 to a state shown in FIG. 3, the movable side arm 21 of the torsion coil spring 20 is twisted by the rotary member 17 by a certain angle. An elastic force corresponding to an amount of torsion, that is, an amount of elastic deformation accumulates in the torsion coil spring 20. In other words, when the lower frame 5 is turned downwards to be opened, the wire 14 wound around the outer periphery of the rotary member 17 is drawn out and the rotary member 17 thereby rotates. Hence, an elastic force applied in a direction of reverse rotation gradually accumulates in the torsion coil spring 20, which is fixed at one end thereof onto the rotary member.

Herein, the elastic force thus accumulating in the torsion coil spring 20 is a force causing the rotary member 17 to rotate counterclockwise in FIG. 4. As far as the lower frame 5 is concerned, this force turns it upwards. As a result of this accumulation of the elastic force in the torsion coil spring 20, the accumulating elastic force serves as a resistance in turning the lower frame 5 downwards. Thus obtained is a cushioning effect of softening an impact made on the respective components including the turning shaft 6 upon completion of an opening operation that causes the lower frame 5 to drop suddenly.

Because the force applied to the lower frame 5 in its opening direction by its own weight is greater than the winding force of the rotary member 17, the lower frame 5 is not lifted unless an operational force for lifting the lower frame 5 is applied to the operating handle 11.

On the other hand, in making a return from the state shown in FIG. 3 to the state shown in FIG. 2, the user applies an upward force to the operating handle 11 to lift the lower frame 5. At this moment, since the torsion coil spring 20 is prompted to reassume its original state, the rotary member 17 is driven counterclockwise. As the rotary member 17 is driven, the wire 14 is wound up by the outer peripheral face of the rotary member 17. This winding force acts as a force for lifting the lower frame 5 in the suspensory portion 13.

This winding force of the wire 14 serves to assist the operational force of the user, whereby an effect of reducing the load required in closing the lower frame 5 is obtained. Further, since the winding driving force of the torsion coil spring 20 is always a tensile force applied to the wire 14, a winding failure such as slackness of the wire 14 can be prevented.

As described above, when the lower frame 5 turns to open the duplex conveying passage R, the wire 14 is drawn out while the rotary member 17 is rotated as the lower frame 5 turns, and the torsion coil spring 20 accumulates an elastic force causing the rotary member 17 to rotate in the reverse direction while being elastically deformed in accordance with rotation of the rotary member 17. Thus, the load imposed on an operator in opening and closing the lower frame 5 is reduced, the operability in doing maintenance or clearance of the jamming of the apparatus is improved, and the apparatus can be prevented from being destructed by a dropping impact.

The wire winding constitution in this embodiment makes use of the great width L of the guide plates 2 and 3 from the opposite point of view by suspending an opening neighborhood most distant from the turning shaft 6, namely, the turning front end side of the lower frame 5. In other words, although a large opening and closing torque is applied to the turning shaft 6 in the case of the lower frame 5 (movable side member) weighing heavily, the force required for suspensory support decreases as the width L increases.

Thus, the number of turns of the torsion coil spring 20 can be set relatively small. As a result, the height of the rotary member 17 can be held low. Even if the amount of the wire 14 to be drawn out in performing the opening and closing operations is large, the winding constitution requires only a space corresponding to an outer diameter of the rotary member 17 to enable installation.

Consequently, when the amount of the wire 14 to be drawn out in performing the opening and closing operations is large, for example, when a large opening and closing amount is required or when it is desirable to support a point distant from the turning shaft 6 because of a heavy weight of the lower frame 5, the winding effect of the rotary member 17 makes a storage space for the wire 14 remarkably small and can also contribute toward reducing the thickness and size of the opening and closing device 1. This effect is assumed to acquire a special significance henceforward in contending with an increase in capacity of a sheet feeding hopper or an increase in size of the image forming portion resulting from an advancement in specifications of the color image forming apparatus (image forming apparatus) 50.

Next, a second embodiment of the present invention will be described.

Figure 5:
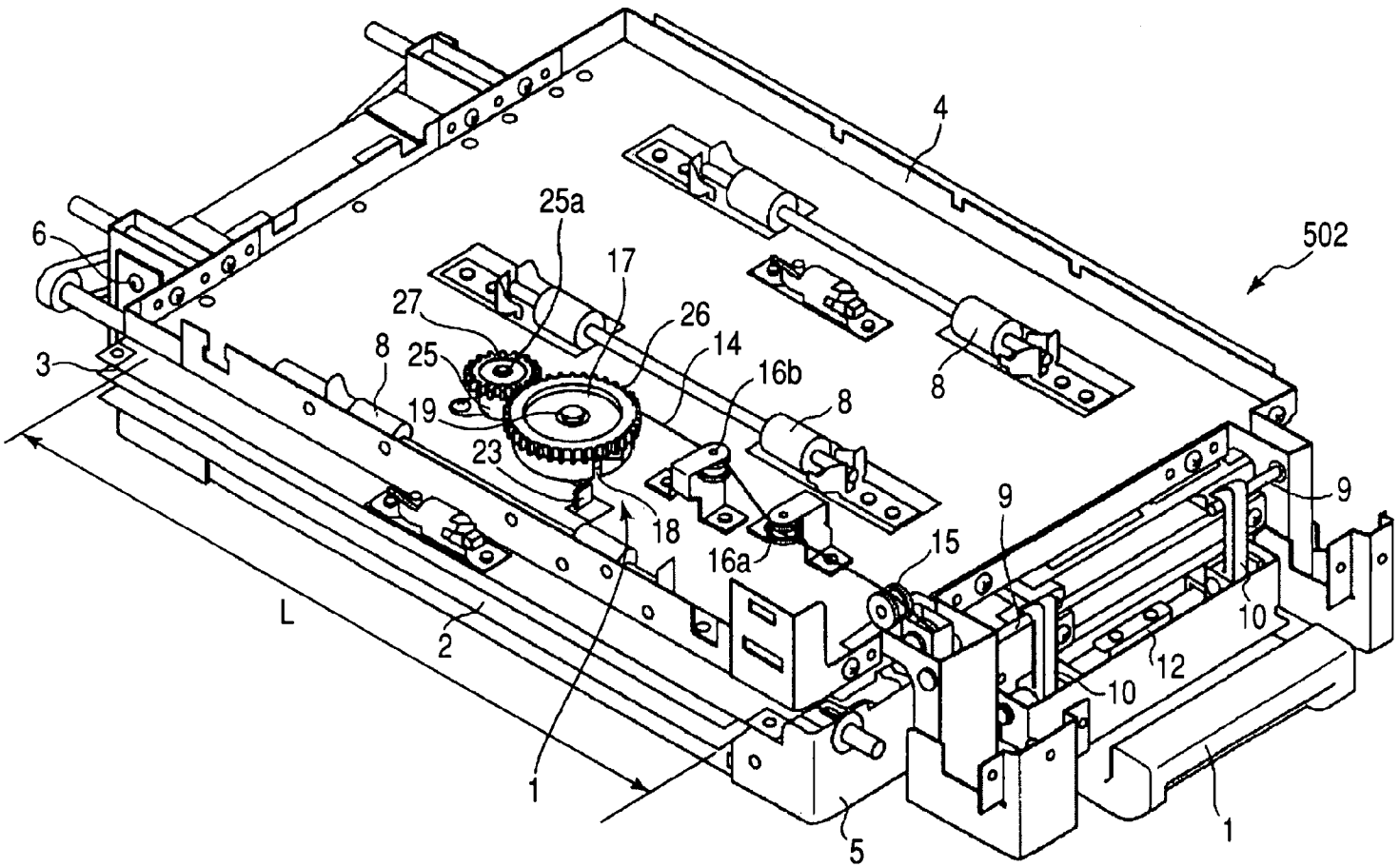
FIG. 5 is a perspective view showing the constitution of a duplex conveying portion provided with an opening and closing device according to a second embodiment of the present invention.

FIG. 5 is a perspective view showing the constitution of a duplex conveying portion provided with an opening and closing device according to this embodiment. Referring to FIG. 5, since the same reference symbols as in FIG. 2 denote the same or equivalent constitution, detailed description thereof is omitted. The constitution different from that of FIG. 2 will be described in detail.

Referring to FIG. 5, reference numeral 25 denotes a damper structured as, for example, a rotary damper utilizing the viscous resistance of oil. This rotary damper 25 is provided on a shaft of a gear 27 coupled to a gear tooth flank 26 formed on the outer periphery of the rotary member 17. A one-way clutch 25*a* as rotation transmitting means is provided on a shaft of the rotary damper 25. Owing to a locking operation of this one-way clutch 25*a*, the rotary damper 25 operates only when the gear 27 rotates counterclockwise in FIG. 5.

Figure 6:
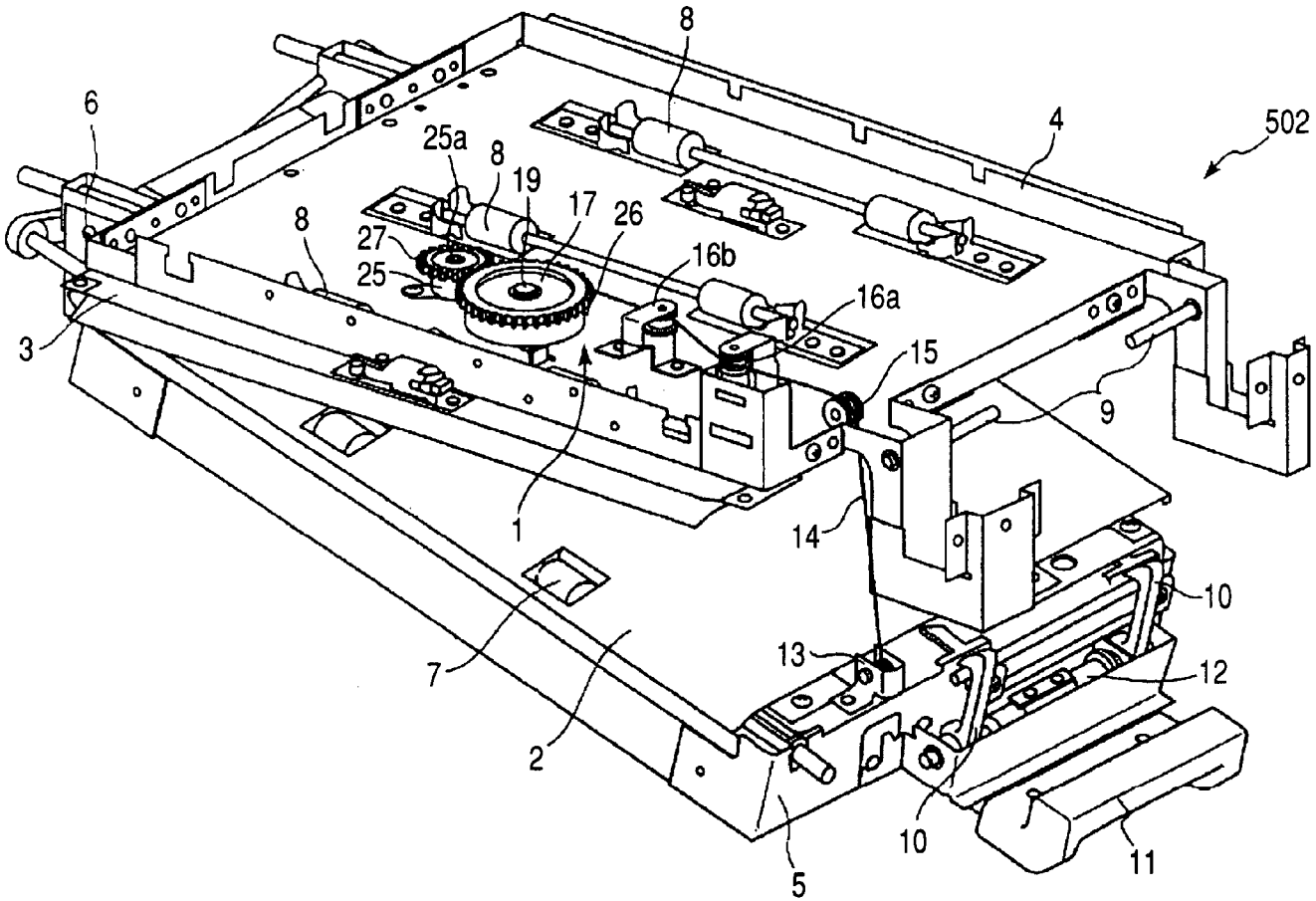
FIG. 6 is a view showing a state where a lower frame of the duplex conveying portion has been turned downwards.

Herein, in the opening and closing device 1 thus constituted, when the lower frame 5 turns downwards because of its own weight through an operation of the operating handle 11 as shown in FIG. 6, the wire 14 attached to the suspensory portion 13 is pulled downwards and drawn out by an opening amount while causing the rotary member 17 to rotate clockwise. When the rotary member 17 thus rotates, the gear 27 is driven counterclockwise. Then, due to the locking operation of the one-way clutch 25*a*, rotation of the rotary member 17 is transmitted to the rotary damper 25. The rotational speed of the rotary member 17 is thereby reduced.

As a result, in making a transition from a state shown in FIG. 5 to a state shown in FIG. 6, an elastic force gradually accumulates in the torsion coil spring 20. Due to a reduction in the rotational speed of the rotary member 17 resulting from the elastic force and a cushioning force of the rotary damper 25, there is obtained a cushioning effect of softening an impact made on the respective components including the turning shaft 6 upon completion of an opening operation that causes the lower frame 5 to drop suddenly.

On the other hand, in making a return from the open state as shown in FIG. 6 to the state shown in FIG. 5, the user applies an upward force to the operating handle 11 to lift the lower frame 5. At this moment, since the torsion coil spring 20 is prompted to reassume its original state, the rotary member 17 is driven counterclockwise. At this moment, since the one-way clutch 25*a* rotates idly, rotation of the rotary member 17 is not transmitted to the rotary damper 25 and only the gear 27 rotates by itself. Thus, the rotary damper 25 does not prevent the operation of winding the wire 14 around the outer peripheral face of the rotary member 17, and the winding force surely acts as an assist force for lifting the lower frame 5 in the suspensory portion 13.

Because the force applied to the lower frame 5 in its opening direction by its own weight is greater than the winding force, the lower frame 5 is not lifted unless an operational force is applied to the operating handle 11. As a result, the winding force applied to the wire 14 functions as a force for assisting an operational force of the user, and an effect of reducing the load required in closing the lower frame 5 is obtained. Further, since the winding force of the torsion coil spring 20 is not canceled out by the rotary damper 25, a winding failure such as slackness of the wire 14 can be prevented.

Thus, the use of the rotary damper 25 and the one-way clutch 25*a* makes it possible to bring out an effect even if the lower frame 5 weighs more heavily than in the aforementioned case of the first embodiment. Effectiveness is also obtained, for example, in the case where it is desirable to impart an air of high quality suited for a high-specifications machine to the operation of the opening and closing portion. In addition, by dispersing a load through compatible use of the torsion coil spring 20 and the rotary damper 25 and optimizing a gear ratio in a transmitting portion of the gears 26 and 27, the rotary damper 25 can be tuned to hold its torque capacity small. Therefore, the installation space for the wire 14 and the rotary damper 25 can be significantly reduced with ease. Consequently, the thickness and size of the image forming apparatus can be reduced.

Next, a third embodiment of the present invention will be described.

Figure 7:
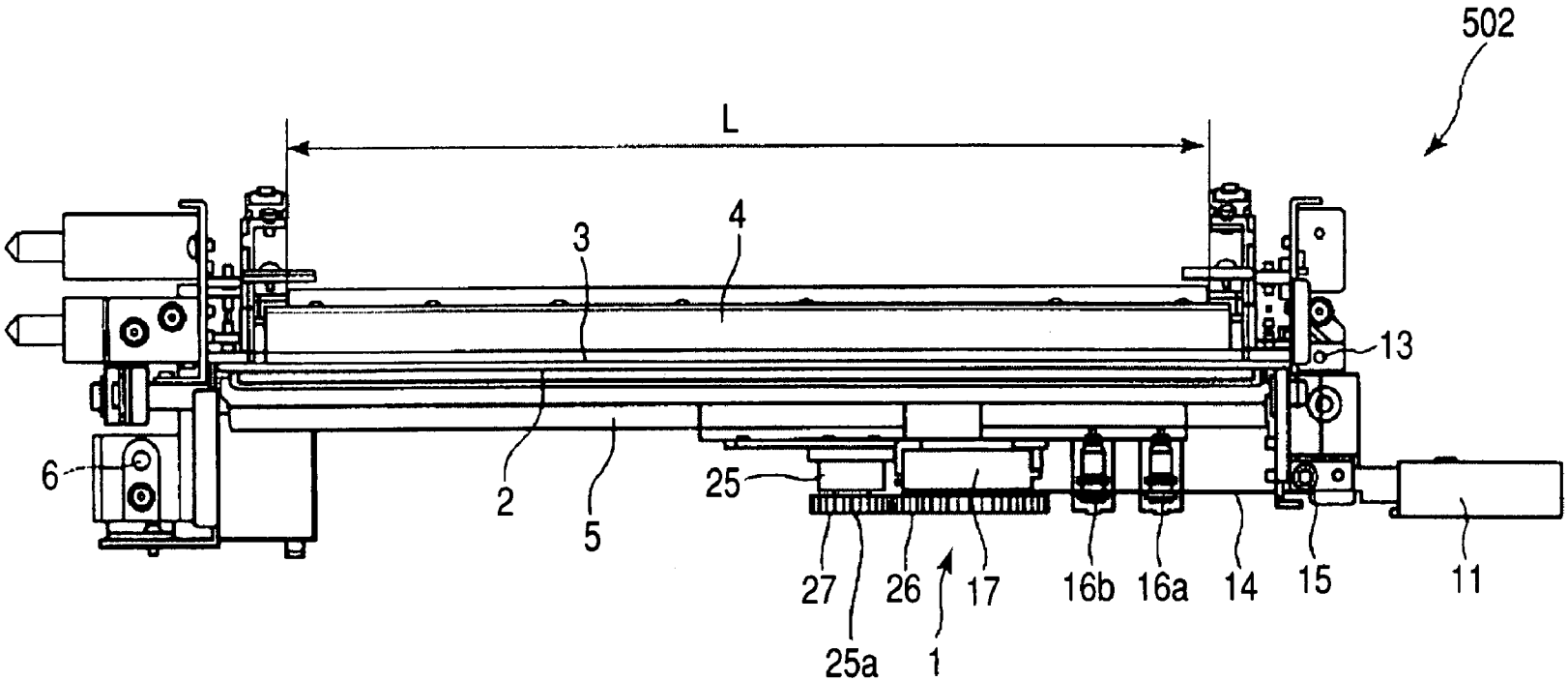
FIG. 7 is a side view showing the constitution of a duplex conveying portion provided with an opening and closing device according to a third embodiment of the present invention.

FIG. 7 is a side view showing the constitution of a duplex conveying portion provided with an opening and closing device according to this embodiment. Referring to FIG. 7, since the same reference symbols as in FIG. 5 denote the same or equivalent constitution, detailed description thereof is omitted. The constitution different from that of FIG. 2 will be described in detail. This embodiment is different from the second embodiment in that the rotary member 17 and the rotary damper 25 are attached to the lower frame 5.

In the constitution as described above, the suspensory portion 13 is provided in proximity to the opening portion of the upper frame 4, namely, on the side of the turning front end of the lower frame 5. The wire 14, which is fixed at one end thereof to the suspensory portion 13, is bent by the relay pulley 15 provided in proximity to the turning front end of the lower frame 5, further guided by the pulleys 16*a* and 16*b*, and then coupled to the rotary member 17.

Figure 8:
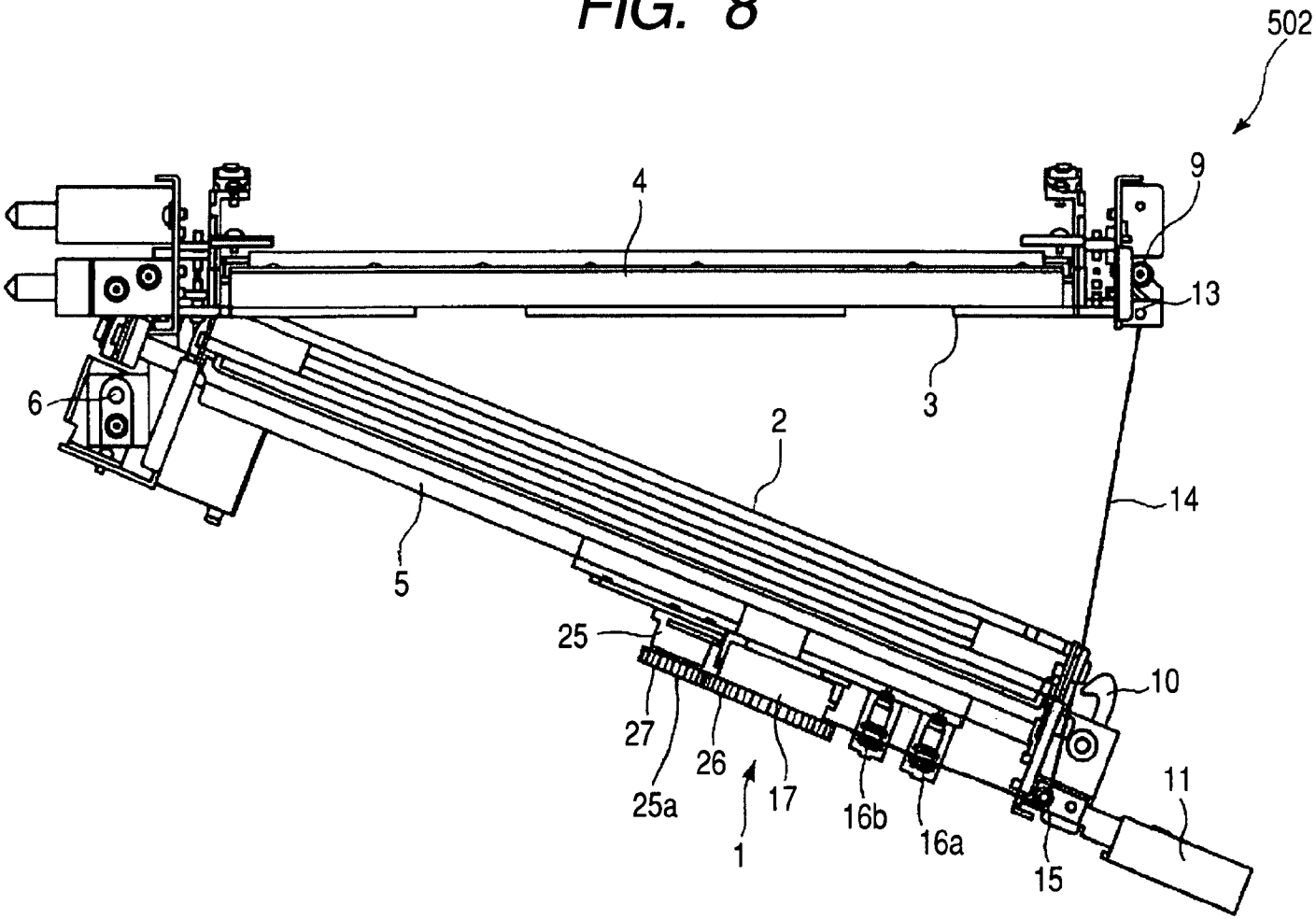
FIG. 8 is a view showing a state where a lower frame of the duplex conveying portion has been turned downwards.

In the opening and closing device 1 thus constituted, when the lower frame 5 turns downwards to be opened, the weight of the lower frame 5 is applied to the wire 14 through abutment on the relay pulley 15 as shown in FIG. 8. Thus, a tensile force is produced in the wire 14. The wire 14 is drawn out while causing the rotary member 17 to rotate, and the relay pulley 15 slides downwards along the wire 14, whereby the lower frame 5 is opened. In this process, a rotational force of the rotary member 17 is transmitted to the rotary damper 25 through a locking operation of the gears 26 and 27 and the one-way clutch 25*a* as rotation transmitting means.

As a result, in making a transition from a state shown in FIG. 7 to a state shown in FIG. 8, the elastic force accumulating in the torsion coil spring 20 and the cushioning force of the rotary damper 25 achieve a cushioning effect of softening an impact made on the respective components including the turning shaft 6 upon completion of an opening operation that causes the lower frame 5 to drop suddenly.

Further, when the lower frame 5 is closed, transmission of a driving force to the rotary damper 25 is interrupted by idle rotation of the one-way clutch 25*a*. Therefore, the effects of reducing an operational force and preventing a winding failure of the wire by an elastic force of the torsion coil spring 20 can be obtained.

In other words, when the rotary member 17 and the like cannot be easily mounted on the fixed side (on the side of the upper frame) as in the aforementioned cases of the first and second embodiments, a similar effect can be obtained by providing the lower frame 5 with the rotary member 17 and the like as in this embodiment. Further, if there is a space below the lower frame 5, the degree of freedom in arranging the wire 14 is enhanced, and a plurality of sets of opening and closing devices 1 can also be easily provided as circumstances demand. For instance, if the lower frame 5 is very bulky, the opening and closing operations can be performed in a laterally well-balanced manner by adopting a two-wire suspension method in which two suspensory portions 13 are provided at both ends of the turning end respectively.

Next, a fourth embodiment of the present invention will be described.

Figure 9:
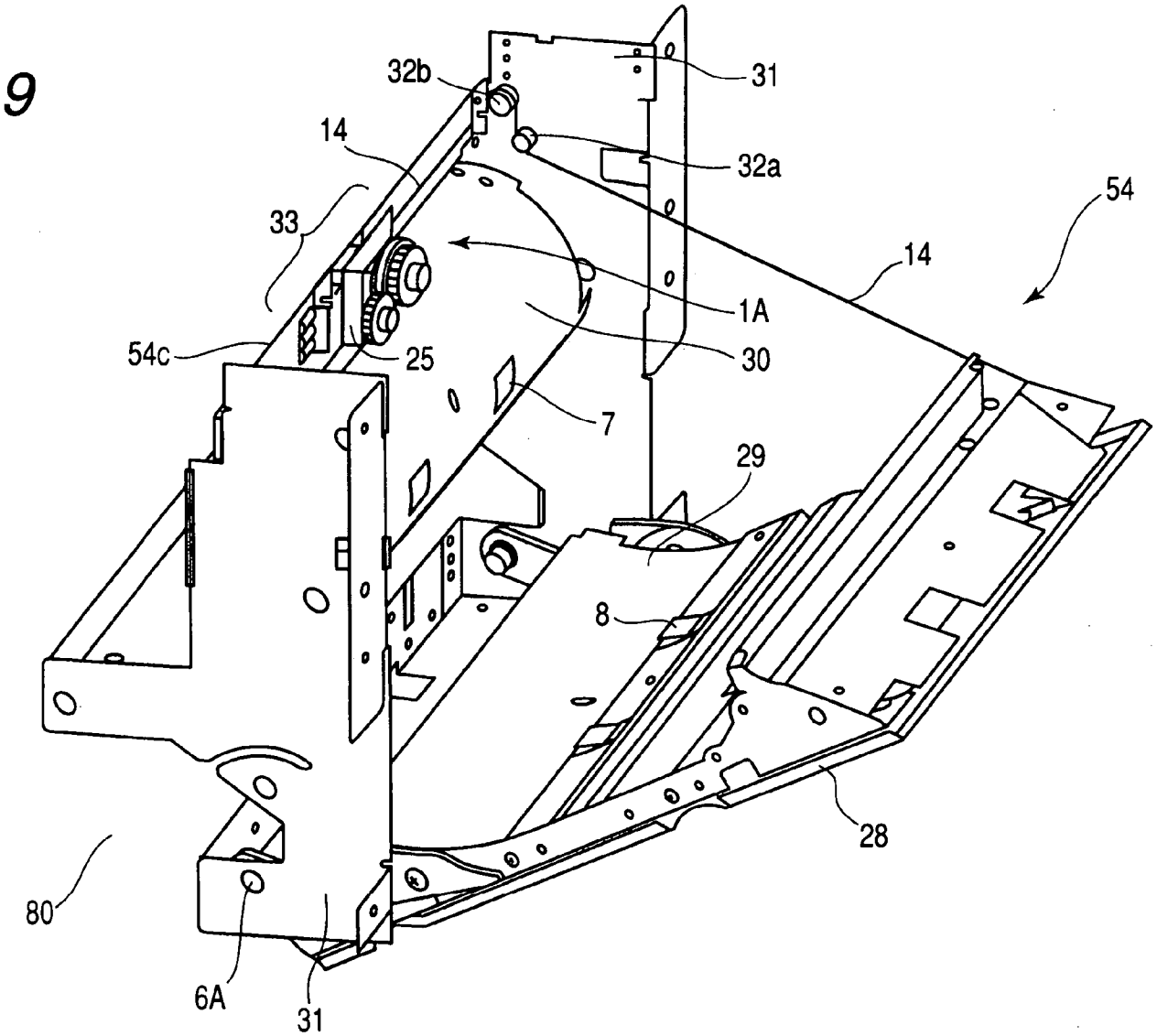
FIG. 9 is a perspective view showing the constitution of a sheet conveying portion provided with an opening and closing device according to a fourth embodiment of the present invention.

FIG. 9 is a perspective view showing the constitution of a sheet conveying portion provided with an opening and closing device according to this embodiment. Referring to FIG. 9, since the same reference symbols as in FIG. 1 denote the same or equivalent constitution, detailed description thereof is omitted. The constitution different from that of FIG. 2 will be described in detail.

Referring to FIG. 9, reference numeral 28 denotes a door (movable side member) that is so retained by lower end portions of lateral wall members 31 (fixed side members) of the sheet conveying portion 54 as to turn around a turning shaft 6A. When the door 28 is turned downwards to be opened, an outer guide plate 29 turns together with the door 28. Herein, this outer guide plate 29 and an inner guide plate 30 as a fixed member constitute the conveying path 54*a* and the sheet re-feeding path 54*b* (see FIG. 1). When the outer guide plate 29 thus turns, the conveying path 54*a* and the sheet re-feeding path 54*b* are opened.

When the door 28 is closed, the inner guide plate 30 and the outer guide plate 29 form the conveying path 54*a* and the sheet re-feeding path 54*b* respectively, and the driving roller 7 provided in the inner guide plate 30 and the driven roller 8 provided in the outer guide plate 29 are in pressure-contact to each other to enable the conveyance of sheets.

In this embodiment as well, since an advancement in specifications makes it necessary to handle a great variety of sheets, increase durability, cope with high-speed conveyance, etc., the door 28, the guide plates, and the like are mainly made of metals. Further, since the guide plates 29 and 30 are great in width and the sheet re-feeding path 54*b* is large in radius of curvature, the sheet conveying portion 54 is bulky. Accordingly, a large load is applied instantaneously when the door 28 opens, and hence, the operator finds it burdensome to perform an operation.

Further, in the case of a constitution where sheets are substantially vertically conveyed as in this embodiment, since the center of gravity of the door 28 (movable side member) is located much higher than the turning shaft 6A in comparison with the aforementioned first to third embodiments, the impact resulting from free fall is increased.

Thus, this sheet conveying portion 54 is also provided with an opening and closing device 1A for softening a dropping impact made after the opening of the door 28.

Herein, this opening and closing device 1A is provided with the wire 14 that is fixed at one end thereof to a lateral face or the like of an upper end portion as a turning end side of the door 28 by means of a screw or the like, a winding device 33 that fixes the other end of the wire 14 set up suitably via relay pulleys 32*a* and 32*b* provided on one of the lateral wall members 31, and the rotary damper 25.

Figure 10:
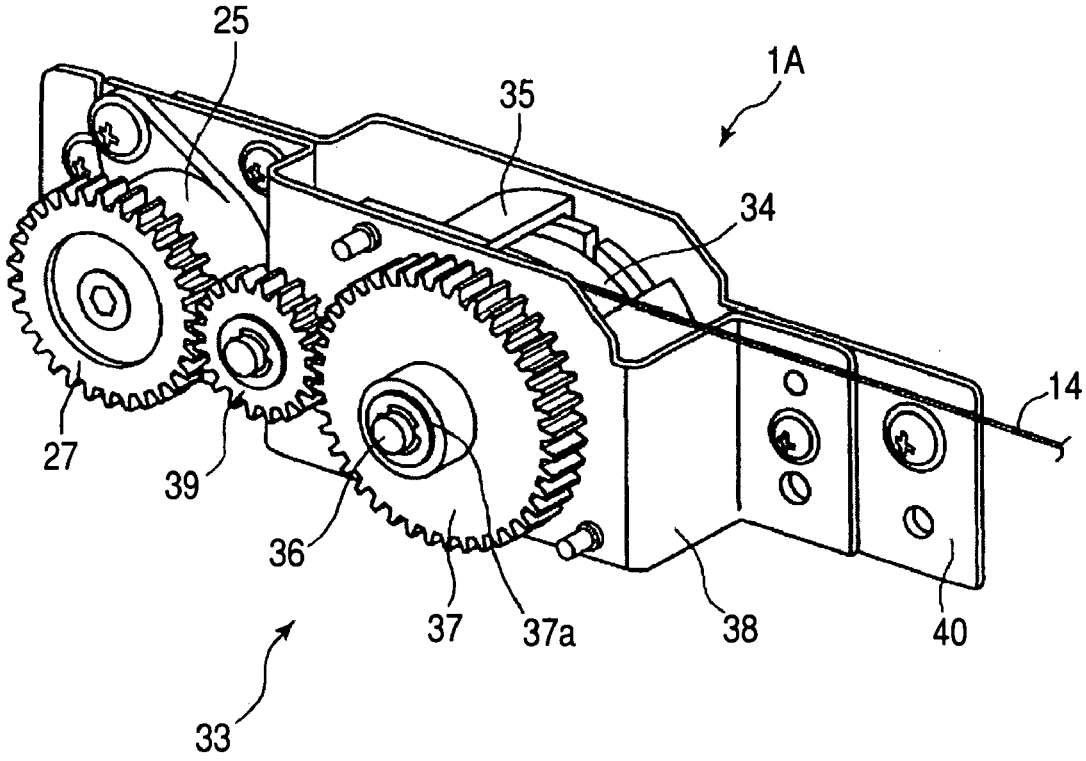
FIG. 10 is a perspective view illustrating a winding device constituting the opening and closing device.

FIG. 10 is a perspective view of the winding device 33 described above. This winding device 33 is provided with a lower support plate 40 fixed to a frame 54*c* (see FIG. 9) hung between the lateral wall members, an upper support plate 38 fixed to the lower support plate 40, a case member 35 fixed to the upper support plate 38, and a rotary member 34 that is provided in a space formed between the case member 35 and the upper support plate 38 to wind up the wire 14. In a state of normal conveyance, namely, when the door 28 is closed, the wire 14 is accommodated in the case member 35 with a plurality of turns thereof wound around an outer peripheral face of the rotary member 34 as shown in FIG. 11.

A center shaft 36, to which the rotary member 34 is fixed, penetrates laterally from the upper support plate 38 as shown in FIG. 10 via a bearing (not shown) or the like. In addition, this center shaft 36 is provided with a one-way clutch 37*a* as rotation transmitting means via a gear 37. Herein, this one-way clutch 37*a* is set to be locked with respect to the center shaft 36 when the rotary member 34 rotates clockwise in FIG. 10 in accordance with an opening (downward turning) operation of the door 28. Thus, the gear 37 transmits rotation of the rotary member 34 to the rotary damper 25 via the gear 27 only in that direction.

In this embodiment, because of space limitations, an idler gear 39 is disposed between the gear 37 and the gear 27 located on the shaft of the rotary damper 25 so as to regulate the diameter of the gear 37, and as a result, rotation of the gear 37 is transmitted to the gear 27 via the idler gear 39. However, the gear 37 and the gear 27 may directly mesh with each other.

Figure 11:
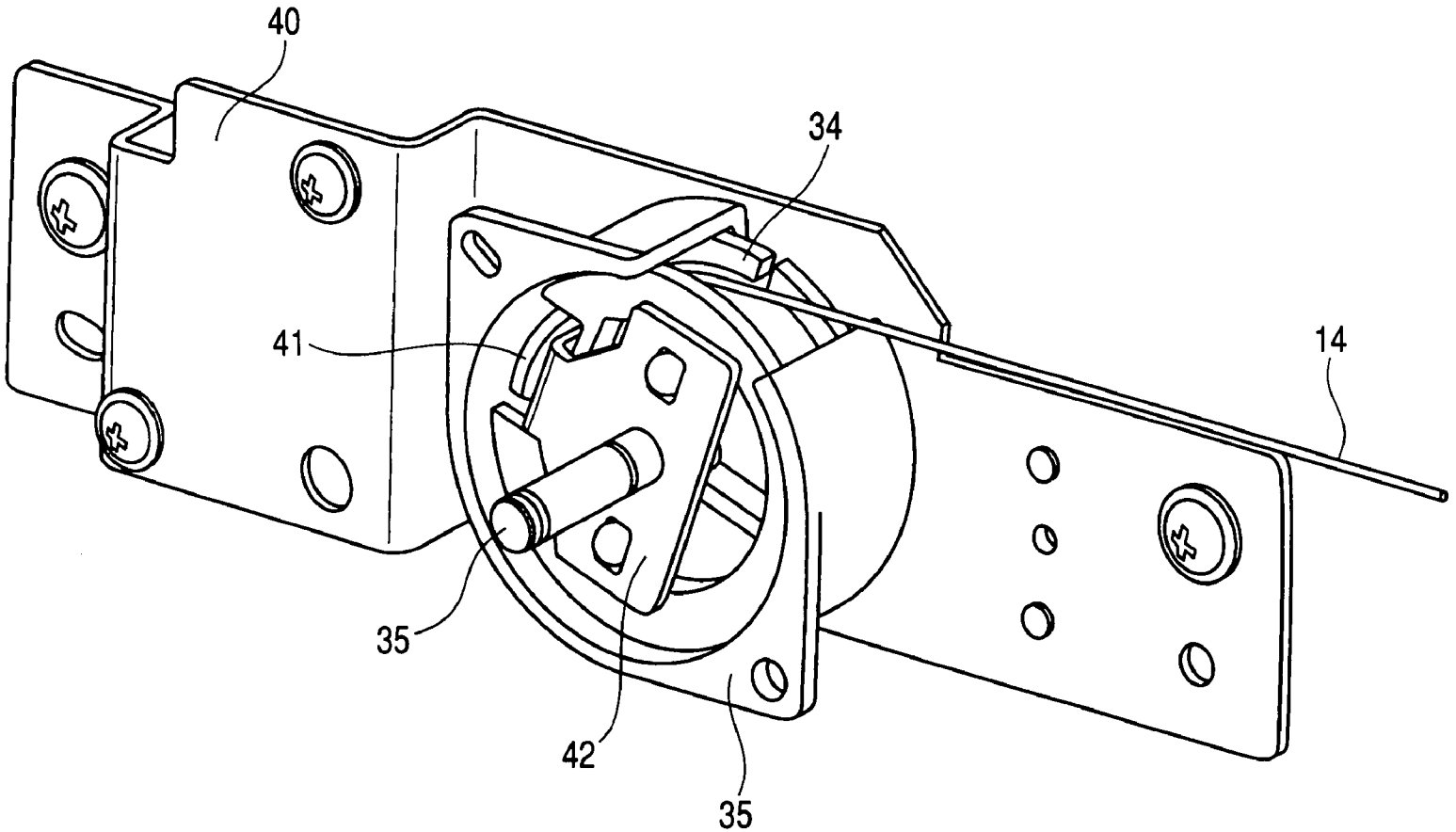
FIG. 11 is a perspective view illustrating the internal structure of the winding device.

As shown in FIG. 11, the wire 14 is wound around the outer peripheral face of the rotary member 34, and is fixed at one end thereof to the rotary member 34 by a steady pin 41. Accordingly, the wire 14 is wound up as the rotary member 34 rotates counterclockwise. The center shaft 36 is fixed to a fixed plate 42 by caulking and securely positioned at a center position of the rotary member 34.

Figure 12:
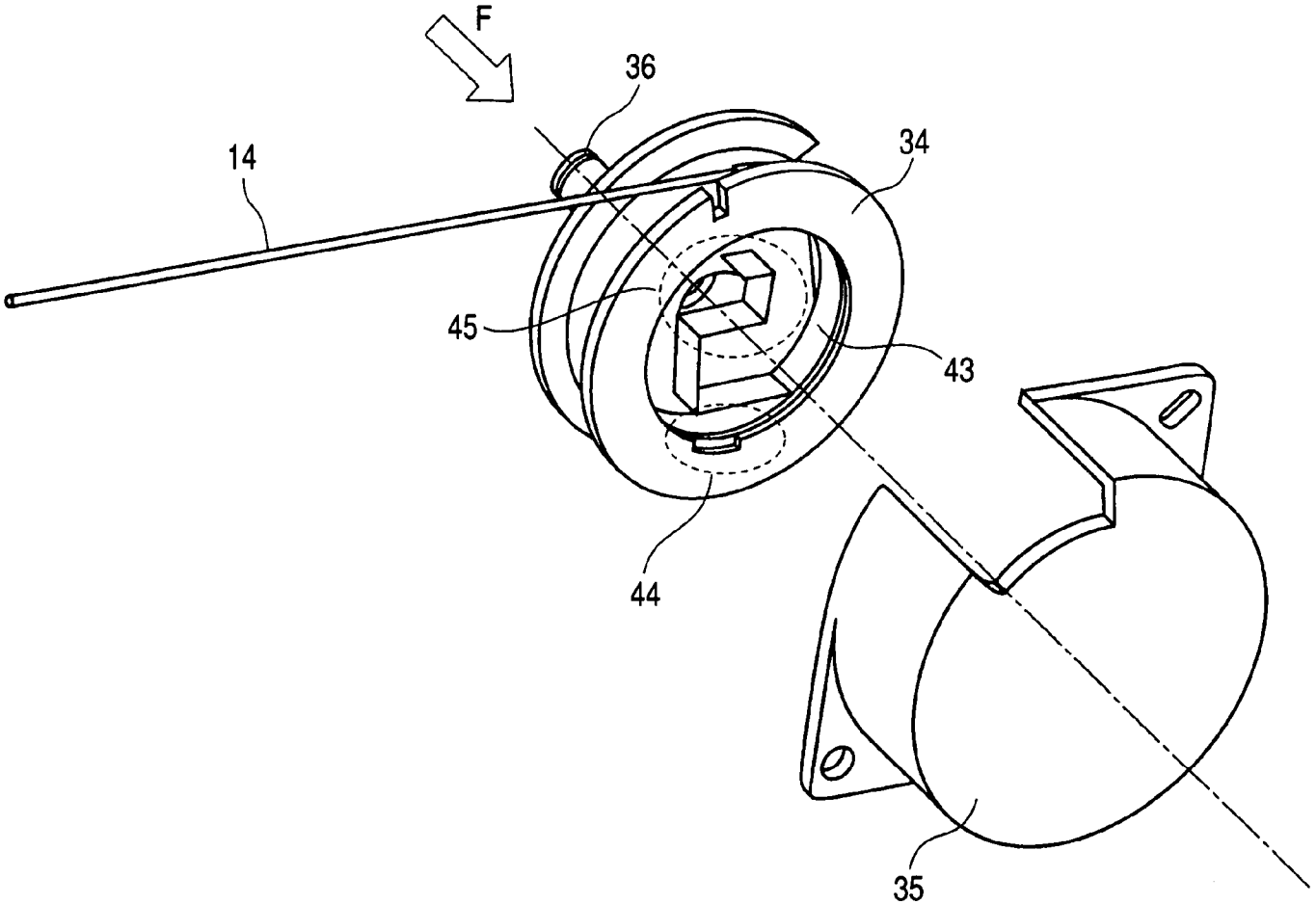
FIG. 12 is a perspective view illustrating a relationship between the rotary member and a leaf spring.

FIG. 12 is a perspective view of the rotary member 34 shown in FIG. 11 as viewed from its back side. For convenience of explanation, the rotary member 34 and the case member 35 are illustrated in a coaxially separated state in FIG. 12.

As shown in FIG. 12, a long leaf spring 43, which has been wound by a plurality of turns, is accommodated inside the rotary member 34. One end of this leaf spring 43 is hooked in a slit groove 44 formed in an inner face of the rotary member 34, so that the leaf spring 43 is so fixed as to be able to rotate together with the rotary member 34. Further, the other end of the leaf spring 43 is so set as to be located close to the center when the leaf spring 43 is wound inside the rotary member 34. The other end of the leaf spring 43 has a hook-shaped portion 45 hooked on a center shaft 46.

Figure 13:
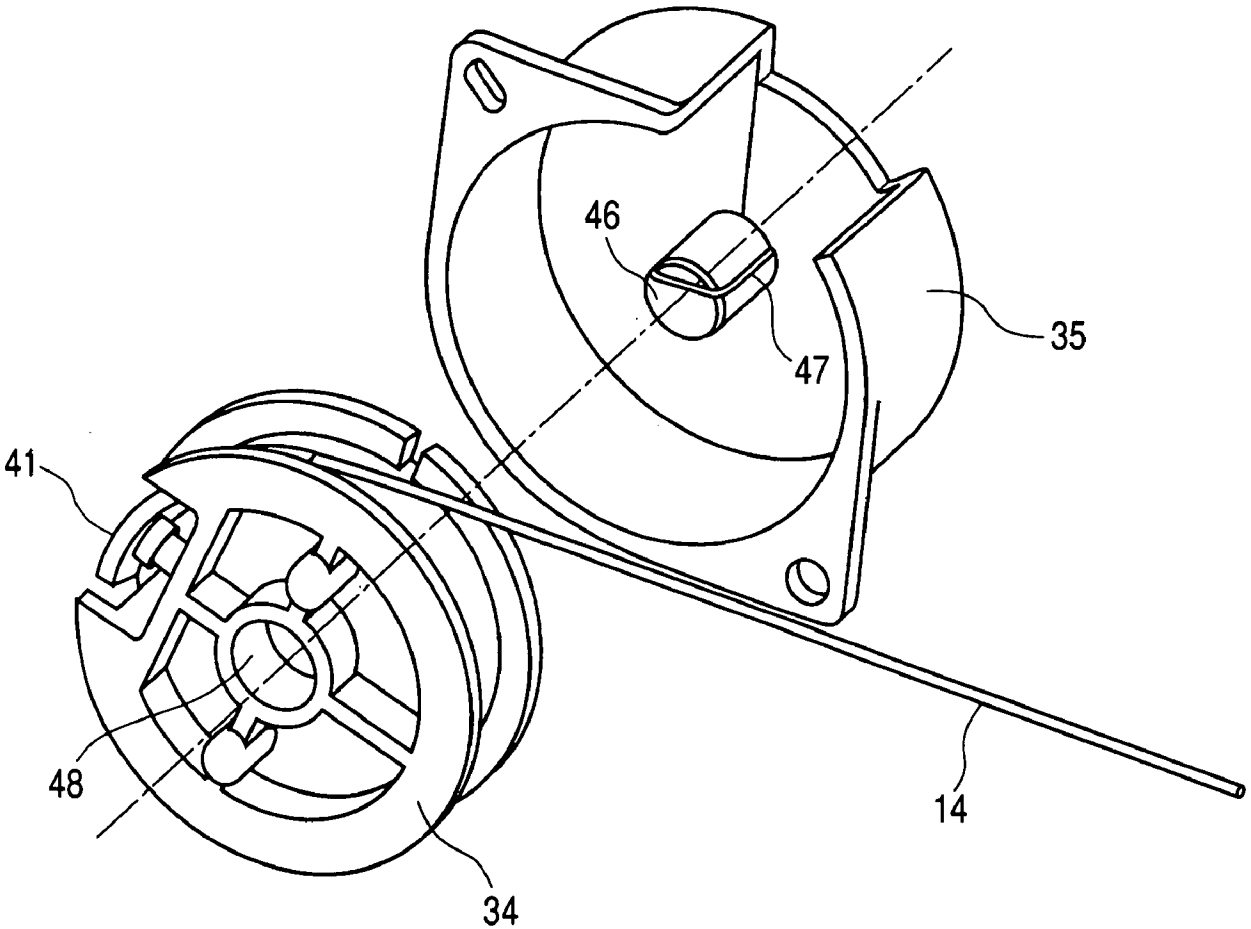
FIG. 13 is a perspective view illustrating a relationship between the rotary member and a case member.

Herein, this hook-shaped portion 45 is fixed on the side of the case member 35 as a non-rotary member by being hooked in a slit groove 47 shown in FIG. 13, which is provided in the center shaft 46 of the case member 35 as a fixed member. Further, by fitting a center hole 48 onto the center shaft 46 of the case member 35, the rotary member 34 is rotatably supported by the case member 35.

In the opening and closing device 1A thus constituted, when the door 28 is opened and turns downwards as shown in FIG. 9, the wire 14 is pulled and drawn out by a length corresponding to an opening amount while causing the rotary member 34 to rotate clockwise as viewed from an observing point of FIG. 12. At this moment, since the leaf spring 43 is squeezed in such a direction as to reduce its diameter by rotation of the rotary member 34, an elastic force accumulates in the leaf spring 43. In this embodiment, when the door 28 is opened by a predetermined angle, it abuts on a stopper (not shown) and cannot turn any further.

Herein, the accumulated elastic force, which urges the rotary member 34 to rotate counterclockwise, is a driving force in a reverse rotational direction when viewed from a rotational direction in the case where the door 28 opens. Besides, the gear 37 rotates together with the rotary member 34 due to the locking of the one-way clutch 37*a*, and thereby transmits a driving force to the idler gear 39 and the gear 27. The rotary damper 25 is thus caused to rotate clockwise, and a damping force is generated against the opening of the door 28.

On the other hand, when the user lifts the door 28 to close it from the open state shown in FIG. 9, the leaf spring 43 is prompted to reassume its original state. Therefore, the rotary member 34 is driven counterclockwise. In this case, since the one-way clutch 37*a* rotates idly, transmission of rotation from the gear 37 to the rotary damper 25 is interrupted.

Accordingly, the elastic force resulting from the leaf spring 43 acts as a wire winding force without being canceled out by the rotary damper 25. Through rotation of the rotary member 34, the wire 14 is accommodated while being wound around the outer peripheral face of the rotary member 34. Because the force applied to the door 28 in its opening direction by its own weight is greater than the winding force, the door 28 is not lifted unless the user applies an operational force thereto.

Thus, the force for winding the wire 14 acts as a force assisting the operational force of the user and can reduce the load required in closing the door 28. Further, since the winding driving force of the leaf spring 43 is always a tensile force acting on the wire 14, a winding failure such as slackness of the wire 14 can be prevented.

When a large opening amount is required as in the case of the sheet conveying portion 54 shown in FIG. 9 or when the outer diameter of the rotary member 34 cannot be made large enough to deal with the length of the wire, the wire 14 needs to be wound up by a plurality of turns in being wound to be accommodated. Herein, since the torsion coil spring used in the aforementioned first to third embodiments has an angle of torsion that is limited in movable range, the use of the leaf spring 43 with a large upper-limit number of turns as in this embodiment makes it possible to wind up the wire 14 by a plurality of turns. In other words, the use of the leaf spring 43 makes it possible to wind up the wire 14 by a plurality of turns.

As a result, even when the heavy door 28 (movable side member) is opened and closed by a large amount, it is possible to constitute the opening and closing device 1A with a substantially narrow installation space and also, to contribute toward reducing the thickness and size of the sheet conveying portion 54 to be mounted. Although the winding device 33 is provided on the side of the lateral wall member (on the fixed side) in this embodiment, a similar effect can be achieved even if the winding device 33 is provided on the side of the door (on the movable side) as in the case of the aforementioned third embodiment.

The foregoing description handles the case where the duplex conveying portion 502 is provided with the opening and closing device 1 and the case where the sheet conveying portion 54 is provided with the opening and closing device 1A. However, the present invention is not limited to those cases. It goes without saying that the present invention is also applicable to other opening and closing portions, for example, an opening and closing portion provided with a fixed side member and a movable side member turnably retained at an end of the fixed side member.

This application claims priority from Japanese Patent Application No. 2004-096920 filed on Mar. 29, 2004, which is hereby incorporated by reference herein.

What is claimed is:

1. An opening and closing device, comprising:

a fixed side member;

a movable side member retained by the fixed side member to be opened and closed;

a wire member that is fixed at one end thereof to one of a turning front end of the movable side member and the fixed side member on a side of the turning front end of the movable side member;

a rotary member, which is provided in the other of the fixed side member and the movable side member, has the wire member wound therearound when the movable side member is closed, and the rotary member is rotated in such a drawing direction as to draw out the wire member according to the opening of the movable side member;

an elastic member that is provided in the rotary member and accumulates an elastic force which causes the rotary member to rotate reversely to the rotation of the drawing direction due to rotation of the rotary member in the drawing direction;

a damper which reduces a speed of the rotation of the rotary member; and rotation transmitting means which selectively transmits the rotation of the rotary member to the damper, wherein the rotation transmitting means transmits rotation of the rotary member to the damper while the movable side member is opened, and does not transmit rotation of the rotary member to the damper while the movable side member is closed.

2. An opening and closing device, comprising:

a fixed side member;

a movable side member retained by the fixed side member to be opened and closed;

a wire member that is fixed at one end thereof to one of the fixed side member and the movable side member;

a rotary member, which is provided in the other of the fixed side member and the movable side member, has the wire member wound therearound when the movable side member is closed, and the rotary member is rotated in such a drawing direction as to draw out the wire member according to the opening of the movable side member;

an elastic member that is provided in the rotary member and accumulates an elastic force which causes the rotary member to rotate reversely to the rotation of the drawing direction, due to rotation of the rotary member in the drawing direction;

a damper which reduces a speed of the rotation of the rotary member;

rotation transmitting means which selectively transmits the rotation of the rotary member to the damper, wherein the rotation transmitting means transmits rotation of the rotary member to the damper while the movable side member is opened, and does not transmit rotation of the rotary member to the damper while the movable side member is closed; and rotation amount regulating means which regulates an opening amount of the movable side member while the movable side member is opened.

3. An opening and closing device according to claim 1 or 2, wherein the elastic member comprises a torsion coil spring.

4. An opening and closing device according to claim 1 or 2, wherein the elastic member comprises a leaf spring that is wound around an inner periphery of the rotary member by a plurality of turns.

5. A sheet conveying apparatus, comprising:

a fixed side member;

a movable side member retained by the fixed side member to be opened and closed;

guide plates provided in the fixed side member and the movable side member, respectively, to guide a sheet, a wire member that is fixed at one end thereof to one of a turning front end of the movable side member and the fixed side member on a side of the turning front end of the movable side member;

a rotary member, which is provided in the other of the fixed side member and the movable side member, has the wire member wound therearound when the movable side member is closed, and the rotary member is rotated in such a drawing direction as to draw out the wire member according to the opening of the movable side member;

an elastic member that is provided in the rotary member and accumulates an elastic force which causes the rotary member to rotate reversely to the rotation of the drawing direction due to rotation of the rotary member in the drawing direction;

a damper which reduces a speed of the rotation of the rotary member; and rotation transmitting means which selectively transmits the rotation of the rotary member to the damper, wherein the rotation transmitting means transmits rotation of the rotary member to the damper while the movable side member is opened, and does not transmit rotation of the rotary member to the damper while the movable side member is closed.

6. A sheet conveying apparatus, comprising:

a fixed side member;

a movable side member retained by the fixed side member to be opened and closed;

guide plates provided in the fixed side member and the movable side member, respectively, to guide a sheet, a wire member that is fixed at one end thereof to one of the fixed side member and the movable side member;

a rotary member that is provided in the other of the fixed side member and the movable side member, has the wire member wound therearound when the movable side member is closed, and the rotary member is rotated in such a drawing direction as to draw out the wire member according to the opening of the movable side member;

an elastic member that is provided in the rotary member and accumulates an elastic force which causes the rotary member to rotate reversely to the rotation of the drawing direction, due to rotation of the rotary member in the drawing direction;

a damper which reduces a speed of the rotation of the rotary member;

rotation transmitting means which selectively transmits the rotation of the rotary member to the damper, wherein the rotation transmitting means transmits rotation of the rotary member to the damper while the movable side member is opened, and does not transmit rotation of the rotary member to the damper while the movable side member is closed; and rotation amount regulating means which regulates an opening amount of the movable side member while the movable side member is opened.

7. A sheet conveying apparatus according to claim 5 or 6, wherein the elastic member comprises a torsion coil spring.

8. A sheet conveying apparatus according to claim 5 or 6, wherein the elastic member comprises a leaf spring that is wound around an inner periphery of the rotary member by a plurality of turns.

9. An image forming apparatus, comprising:

a sheet conveying apparatus including;

a fixed side member;

a movable side member retained by the fixed side member to be opened and closed; and guide plates provided in the fixed side member and the movable side member, respectively, to guide a sheet;

an image forming portion that forms an image on the sheet guided by the guide plates;

a wire member that is fixed at one end thereof to one of a turning front end of the movable side member and the fixed side member on a side of the turning front end of the movable side member;

a rotary member, which is provided in the other of the fixed side member and the movable side member, has the wire member wound therearound when the movable side member is closed, and the rotary member is rotated in such a drawing direction as to draw out the wire member according to the opening of the movable side member;

an elastic member that is provided in the rotary member and accumulates an elastic force which causes the rotary member to rotate reversely to the rotation of the drawing direction due to rotation of the rotary member in the drawing direction;

a damper which reduces a speed of the rotation of the rotary member; and rotation transmitting means which selectively transmits the rotation of the rotary member to the damper, wherein the rotation transmitting means transmits rotation of the rotary member to the damper while the movable side member is opened, and does not transmit rotation of the rotary member to the damper while the movable side member is closed.

10. An image forming apparatus, comprising:

a sheet conveying apparatus including:

a fixed side member;

a movable side member retained by the fixed side member to be opened and closed; and guide plates provided in the fixed side member and the movable side member, respectively, to guide a sheet;

an image forming portion that forms an image on the sheet guided by the guide plates;

a wire member that is fixed at one end thereof to one of the fixed side member and the movable side member;

a rotary member, which is provided in the other of the fixed side member and the movable side member, has the wire member wound therearound when the movable side member is closed, and the rotary member is rotated in such a drawing direction as to draw out the wire member according to the opening of the movable side member;

an elastic member that is provided in the rotary member and accumulates an elastic force which causes the rotary member to rotate reversely to the rotation of the drawing direction, due to rotation of the rotary member in the drawing direction;

a damper which reduces a speed of the rotation of the rotary member;

rotation transmitting means which selectively transmits the rotation of the rotary member to the damper, wherein the rotation transmitting means transmits rotation of the rotary member to the damper while the movable side member is opened, and does not transmit rotation of the rotary member to the damper while the movable side member is closed; and rotation amount regulating means which regulates an opening amount of the movable side member while the movable side member is opened.

11. An image forming apparatus according to claim 9 or 10, wherein the elastic member comprises a torsion coil spring.

12. An image forming apparatus according to claim 9 or 10, wherein the elastic member comprises a leaf spring that is wound around an inner periphery of the rotary member by a plurality of turns.

* * * * *